US011317767B2

(12) United States Patent
Paradis

(10) Patent No.: US 11,317,767 B2
(45) Date of Patent: May 3, 2022

(54) FIELD FABRICATED SHOWER SYSTEM

(71) Applicant: JOHNS MANVILLE, Denver, CO (US)

(72) Inventor: Duane Paradis, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 16/747,025

(22) Filed: Jan. 20, 2020

(65) Prior Publication Data

US 2020/0229654 A1 Jul. 23, 2020

Related U.S. Application Data

(60) Provisional application No. 62/795,544, filed on Jan. 22, 2019.

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/613
See application file for complete search history.

(56) References Cited

U.S. PATENT DOCUMENTS 6,643,863 B1 * 11/2003 Gerber ..... A47K 3/40 4/613
7,752,686 B2 7/2010 Polimeno
8,176,579 B2 5/2012 Daniels
8,181,288 B1 * 5/2012 Davis, Jr. ..... A47K 3/40 4/613
8,239,974 B2 8/2012 Erlebach
8,850,633 B2 10/2014 Erlebach
9,408,501 B2 8/2016 Erlebach
9,611,634 B2 4/2017 Erlebach
10,182,684 B2 1/2019 Davis, Jr.
10,260,233 B2 4/2019 Meilleur et al.
10,294,652 B2 5/2019 Erlebach
2002/0124306 A1 9/2002 Smale
(Continued)

FOREIGN PATENT DOCUMENTS

DE 200 04 764 U1 6/2000
DE 20 2004 013 374 U1 11/2004
(Continued)

OTHER PUBLICATIONS

Johns Manville, GoBoard® Durable, Ultra-lightweight, Waterproof Tile Backer Board, Brochure 5/18 Johns Manville, USA.
(Continued)

*Primary Examiner* — Jeremy Carroll
(74) *Attorney, Agent, or Firm* — Robert D. Touslee

(57) ABSTRACT

Apparatus and methods for constructing a shower pan. The shower pan is constructed from wedge panels having a foam core and facers on major surfaces of the wedge panels. The wedge panels are cut into portions that fit regions of the shower pan area. The wedge panel portions are placed in the regions such that the sloped upper surfaces of the wedge panel portions collectively form a continuous surface that at all locations slopes downward toward the drain of the shower. Pans for a wide variety of shower shapes and sizes can be constructed. The shower pan may be efficiently constructed on-site, often using common tools and techniques.

16 Claims, 16 Drawing Sheets

(56) References Cited

U.S. PATENT DOCUMENTS

| | | | | |
|---|---|---|---|---|
| 2004/0255547 | A1 | 12/2004 | Flowers | |
| 2006/0213006 | A1 | 9/2006 | Rush et al. | |
| 2008/0222793 | A1* | 9/2008 | Cook | A47K 3/40 4/612 |
| 2008/0276364 | A1* | 11/2008 | Barro | A47K 3/40 4/613 |
| 2010/0162481 | A1 | 7/2010 | Erlebach | |
| 2011/0061161 | A1 | 3/2011 | Erlebach | |
| 2014/0175700 | A1* | 6/2014 | Cook | B29C 45/2673 264/297.2 |
| 2014/0259371 | A1* | 9/2014 | Schaffer | A47K 3/405 4/613 |
| 2015/0026879 | A1 | 1/2015 | Eriksson | |
| 2015/0074898 | A1 | 3/2015 | Erlebach | |
| 2015/0128340 | A1* | 5/2015 | Davis, Jr. | E03F 5/0408 4/613 |
| 2016/0007810 | A1* | 1/2016 | Andres Alemany | B05D 3/007 4/613 |
| 2016/0130794 | A1 | 5/2016 | Erlebach | |
| 2017/0241124 | A1 | 8/2017 | Erlebach | |
| 2017/0326615 | A1* | 11/2017 | Roy | B21D 28/26 |
| 2018/0110379 | A1 | 4/2018 | Wadaga | |
| 2018/0171609 | A1 | 6/2018 | Erlebach | |
| 2018/0171618 | A1 | 6/2018 | Erlebach | |
| 2018/0192830 | A1 | 7/2018 | Fraga | |
| 2019/0323224 | A1 | 10/2019 | Erlebach | |
| 2019/0323225 | A1 | 10/2019 | Erlebach | |
| 2020/0063413 | A1 | 2/2020 | Coy | |
| 2020/0141128 | A1 | 5/2020 | Wedi | |

FOREIGN PATENT DOCUMENTS

| | | | |
|---|---|---|---|
| EP | 2 591 709 | B1 | 11/2012 |
| EP | 2 935 710 | B1 | 12/2013 |
| WO | 2006105107 | A1 | 10/2006 |
| WO | 2012021616 | A2 | 2/2012 |
| WO | 2014186021 | A1 | 11/2014 |
| WO | 2017031107 | A1 | 2/2017 |

OTHER PUBLICATIONS

Johns Manville, DiamondBack® Pre-Cut Crickets Polyisocyanurate Sloped Insulation Panels, Brochure 11/15 Johns Manville, USA.

* cited by examiner

STEP 4, MARKING WEDGE PORTIONS 2 AND 4

STEP 4, CUTTING WEDGE PORTIONS 2 AND 4

FIELD FABRICATED SHOWER SYSTEM

CROSS REFERENCE TO RELATED APPLICATIONS

This application claims the benefit of provisional U.S. patent application No. 62/795,544, filed Jan. 22, 2019 and titled "Field Fabricated Shower System", the entire disclosure of which is hereby incorporated by reference herein for all purposes.

BACKGROUND OF THE INVENTION

FIG. 1 illustrates a typical shower stall 100 as may be installed in a residence. Shower stall 100 includes a space partially enclosed by walls 101. Walls 101 are typically tiled, lined with cultured marble, or covered with another durable waterproof material. A shower head 102 provides a spray of water into the shower stall. The floor or pan 103 of shower stall 100 is shaped such that its surface slopes toward a drain 104, through which waste water flows to a sanitary sewer system beneath shower pan 103. A raised curb 105 prevents water from flowing into the rest of the room that houses shower stall 100, although curbless showers are also possible. The open side 106 of shower stall 100 may be covered by a curtain, glass doors, or other means for containing falling water inside shower stall 100, or in some cases may be left open to the room.

Shower pan 103 may be formed in any of a number of ways. In some showers, a pre-fabricated pan 103 may be used. While a pre-fabricated pan is easy to install, the size of the shower and the position of drain 104 are constrained to the available pre-fabricated pans, or a custom pan must be fabricated.

In other showers, pan 103 is formed in place by pouring concrete or a similar material into the bottom of shower stall 100 and shaping the material as need to form the pan. While a poured-in-place pan is flexible as to the dimensions of the shower and the placement of the drain, a poured-in-place pan requires specialized skills, tools, materials, and processes as compared with the rest of the shower stall fabrication.

SUMMARY OF THE INVENTION

According to one aspect, a wedge panel having first and second major surfaces joined by perimeter edges comprises a closed cell foam core. The first and second major surfaces are square or rectangular having a length of at least 2 feet and a width of at least 2 feet, a first edge of the wedge panel has a thickness of ¼ inch or less, and a second edge of the wedge panel, opposite the first, has a thickness larger than the thickness of the first edge. In some embodiments, at least one of the first and second major surfaces comprises an attached facer. In some embodiments, when one of the first and second major surfaces is held horizontal, the other of the first and second major surfaces has a slope of between 1 and 5 percent. In some embodiments, when one of the first and second major surfaces is held horizontal, the other of the first and second major surfaces has a slope of about 2 percent or more. In some embodiments, the distance between the first edge and the second edge is about 4 feet, the thickness of the first edge is about ⅛ inch, and the thickness of the second edge is greater than 1 inch.

According to another aspect, a method of forming a shower pan in a shower pan area for a shower having a drain and a perimeter surrounding the drain comprises obtaining a number of wedge panels, each of the wedge panels having first and second major surfaces joined by perimeter edges, and each of the wedge panels further comprising a closed cell foam core. The first and second major surfaces are square or rectangular having a length of at least 2 feet and a width of at least 2 feet, a first edge of the wedge panel has a thickness of ¼ inch or less, and a second edge of the wedge panel, opposite the first, has a thickness larger than the thickness of the first edge. The method further comprises dividing the area of the shower pan into regions partially defined by lines at right angles to each other on a floor of the shower pan area and partially defined by the perimeter of the shower pan area, and cutting the wedge panels to form wedge panel portions that fit within respective ones of the regions. At least some cuts of the wedge panels are at 45 degrees to the edges of the wedge panels. The method further comprises placing the wedge panel portions in the respective regions, each of the wedge panel portions being placed with its thinnest edge oriented toward the drain, such that the upper surfaces of the wedge panel portions collectively form a continuous surface that at all locations slopes downward toward the drain. In some embodiments, for each of the wedge panels, at least one of the upper and lower major surfaces has an attached facer. In some embodiments, the method further comprises marking the lines on the floor of the shower pan area. In some embodiments, the method further comprises sealing all joints between the adjacent edges of the wedge panel portions, to form a waterproof shower pan. In some embodiments, the method further comprises applying a finish layer to the upper surface of the shower pan. In some embodiments, the thinnest edge of at least one of the wedge panel portions is a portion of the first edge of its respective wedge panel. In some embodiments, at least one of the wedge panel portions is cut from its respective wedge panel such that the thinnest edge of the wedge panel portion is thicker than the first edge of the respective wedge panel. In some embodiments, the resulting shower is curbless. In some embodiments, the drain is square, and the lines emanate from the corners of the square drain. In some embodiments, the drain is round or linear. In some embodiments, the method further comprises obtaining a curb having a closed cell foam core, placing the curb at an edge of the shower area, and sealing the joints between the curb and the adjacent wedge panel portions. In some embodiments, the method further comprises laying a backer board in an area of the shower pan beyond the perimeter of at least a particular one of the wedge panel portions, and placing an additional wedge panel portion on top of the backer board with the narrowest edge of the additional wedge panel portion adjacent to the particular web panel portion such that the top surfaces of the particular wedge panel portion and the additional wedge panel portion form a continuous sloped surface. In some embodiments, the method further comprises obtaining an additional wedge panel portion, wherein the narrowest edge of the additional wedge portion has a thickness equal to the thickness of a perimeter edge a particular one of the wedge panel portions, and placing the additional wedge panel portion in the shower pan area with its thinnest edge adjacent the particular web panel portion such that the top surfaces of the particular wedge panel portion and the additional wedge panel portion form a continuous sloped surface. In some embodiments, the shower pan area is square or rectangular with a width of up to 48 inches and a length of up to 96 inches, and the shower pan is formed with no more than 4 wedge panels. In some embodiments, the shower pan area is round, or is elliptical, or is a polygonal shape other than square or rectangular, or has a freeform perimeter.

According to another aspect, a shower pan for a shower having a drain comprises a number of sloped segments joined to from a continuous surface that at all locations slopes downward toward the drain. Each sloped segment further comprises a sloped panel having first and second major surfaces at an angle to each other, each sloped panel comprising a closed cell foam core. Each of the sloped panels comprises angled edges cut at 45 degrees from a strike line of the upper major surface of the panel, and the angled edges of adjacent sloped panels match. In some embodiments, for each sloped panel, at least one of the upper and lower major surfaces has an attached facer. In some embodiments, joints between the sloped panels are sealed to form a waterproof shower pan. In some embodiments, the shower pan further comprises a finish layer on top of the sloped panels. In some embodiments, the shower pan is square or rectangular. In some embodiments, the drain is centered in the shower pan. In some embodiments, the drain is square, round, or linear. In some embodiments, the shower pan is curbless. In some embodiments, the shower pan further comprises a curb also comprising a closed cell foam core.

DETAILED DESCRIPTION OF THE INVENTION

Embodiments of the invention may enable efficient construction of a shower pan.

Figure 1:
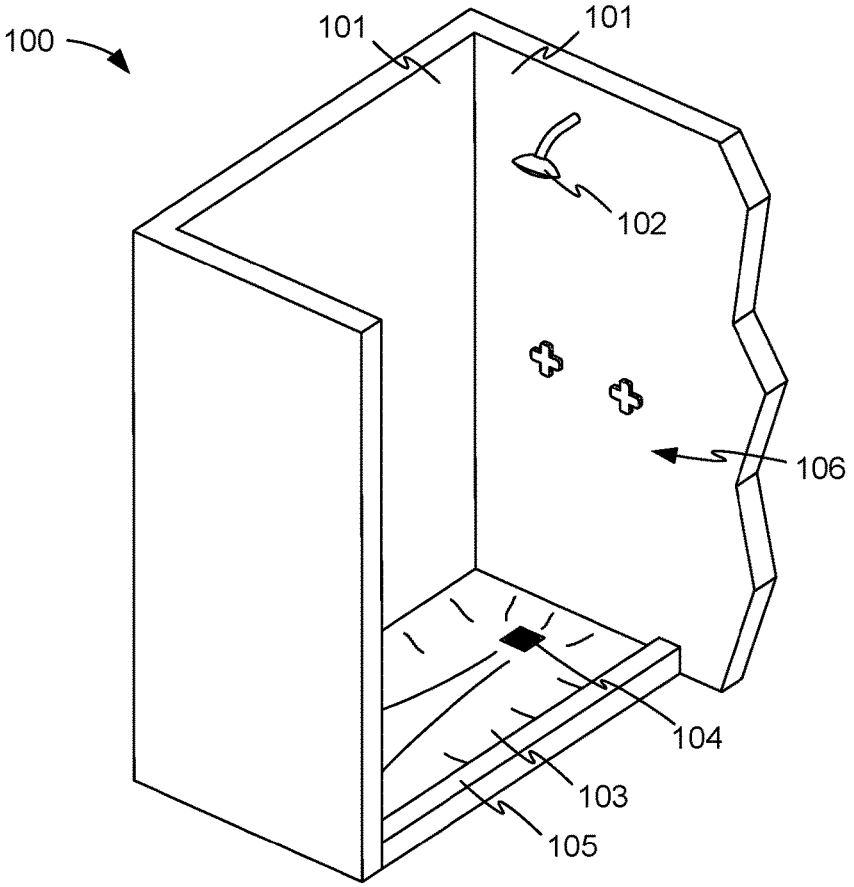
FIG. 1 illustrates a typical shower stall as may be installed in a residence.
Figure 2:
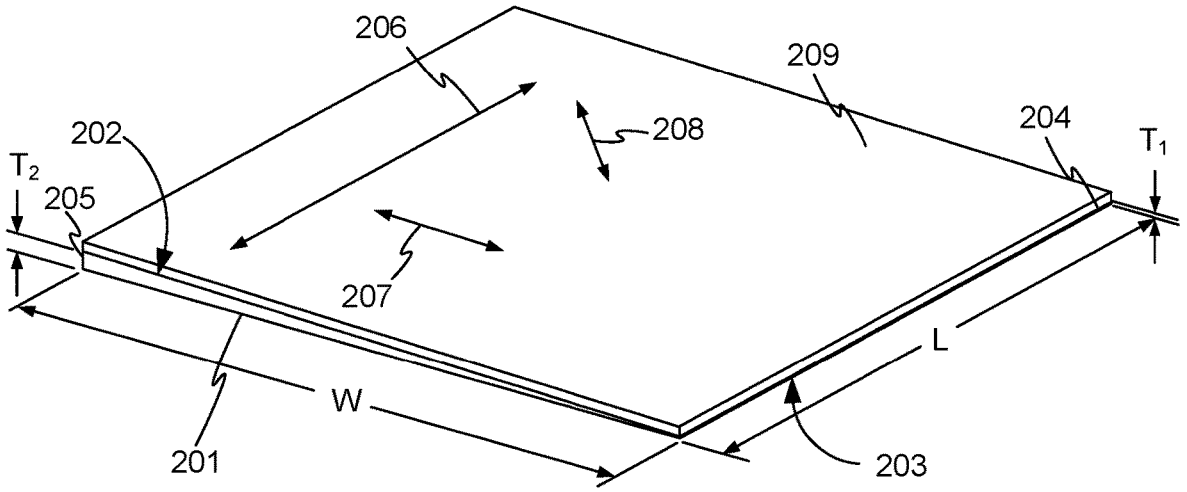
FIG. 2 illustrates a wedge panel, in accordance with embodiments of the invention.

FIG. 2 illustrates a wedge panel 201, in accordance with embodiments of the invention. Wedge panel 201 preferably comprises a rigid closed cell foam core, for example made of polyisocyanurate or polyurethane foam, or another suitable material. The foam core may have a density of about 1.0 $lb/ft^3$ or more, for example 1.0 to 12.0 $lb/ft^3$, or preferably about 2.5 to 6 $lb/ft^3$.

Wedge panel 201 has upper and lower major surfaces 202 and 203, joined by perimeter edges. Wedge panel 201 may include a high tensile strength facer 209 on at least upper major surface 202, and preferably includes facers on both major surfaces. The facers 209 are compatible with sealants, adhesives, and seam tapes suitable for use in embodiments of the invention, for example polyurethane, STPE, MS polymer, acrylic and silicone based sealants and adhesives, as well as acrylic, butyl and SBS based adhesives and seam tapes. In addition, at least the upper facer 209 is compatible with thinset mortars and other tile or stone setting adhesives used to install ceramic, porcelain, natural stone, or other kinds of tile. The facers 209 may be coated to enhance their compatibility with mortars and adhesives. The facers 209 may also be reinforced with scrims to further improve mechanical properties like fastener holding strength, flexural strength and overall board rigidity. In some embodiments, the facers 209 may be made of a fibrous material, for example a woven or nonwoven sheet material including glass, polymer, or other fibers.

In other embodiments, wedge panel 201 may not include any facers. In this case, at least the upper major surface of wedge panel 201 may be worked or treated to enhance its compatibility with adhesives, sealants, thinset mortars, and the like. For example, the foam of the foam core may be sawn, milled, abraded, fly cut, sanded, or otherwise worked. The working may remove or interrupt any skin formed on the foam core in the process of its formation, which skin may be less receptive to adhesives, sealants, or mortars than the foam exposed by working.

When no facers are present, it may be desirable for the foam core to have a somewhat higher density than in a wedge panel having facers. For example, when no facers are present, the density of the foam core may be about 2.0 to 12.0 lb/ft$^3$, or preferably about 2.5 to 8 lb/ft$^3$, although other densities may be used.

Wedge panel 201 may have a length "L" of 48 inches, 96 inches, or another suitable size, and a width "W" of 48 inches, 96 inches, or another suitable size. A narrow edge 204 may have a thickness $T_1$ of ¼ inch or less, preferably about ⅛ inch. Opposite narrow edge face 204, thicker edge 205 may have a thickness of up to one inch or more, preferably about 1 to 2 inches. When lower major surface 203 is held level, the slope of upper major surface 202 may be about 1 to 5 percent, but preferably at least 2 percent. For example, if width "W" is 48 inches, thickness $T_1$ is about ⅛ inch, and the slope of upper major surface 202 is about 2%, then the thickness $T_2$ will be about 1.08 inches. Because the high tensile strength outer facings of wedge panel 201 can be produced at thicknesses of 0.03" or less, it is possible to produce a waterproof foam composite wedge panel with a starting thickness $T_1$ of as little as ⅛" or less. This enables lower curb heights and curbless installations that do not require cutting and modifying underlying structural members (joists).

Also shown in FIG. 2 are strike line 206 and dip line 207, of upper major surface 202. A strike line of an inclined plane is any horizontal line residing within the plane. That is, when lower major surface 203 of wedge panel 201 is held horizontal, strike line 206 and any line parallel to strike line 206 within the plane of upper major surface 202 will be horizontal. A dip line of a plane is a line along which the slope is greatest. In the example of FIG. 2, dip line 207 is parallel to the edges of upper major surface 202, and has the same slope with respect to horizontal as upper major surface 202. Strike line 206 has a slope of zero with respect to lower major surface 203, and intermediate line 208 has a slope between zero and the slope of dip line 207.

In some embodiments, wedge panel 201 and other parts of a shower stall are made of materials like or similar to those used in GoBoard® panels available from Johns Manville, of Denver, Colo., USA.

Figure 3:
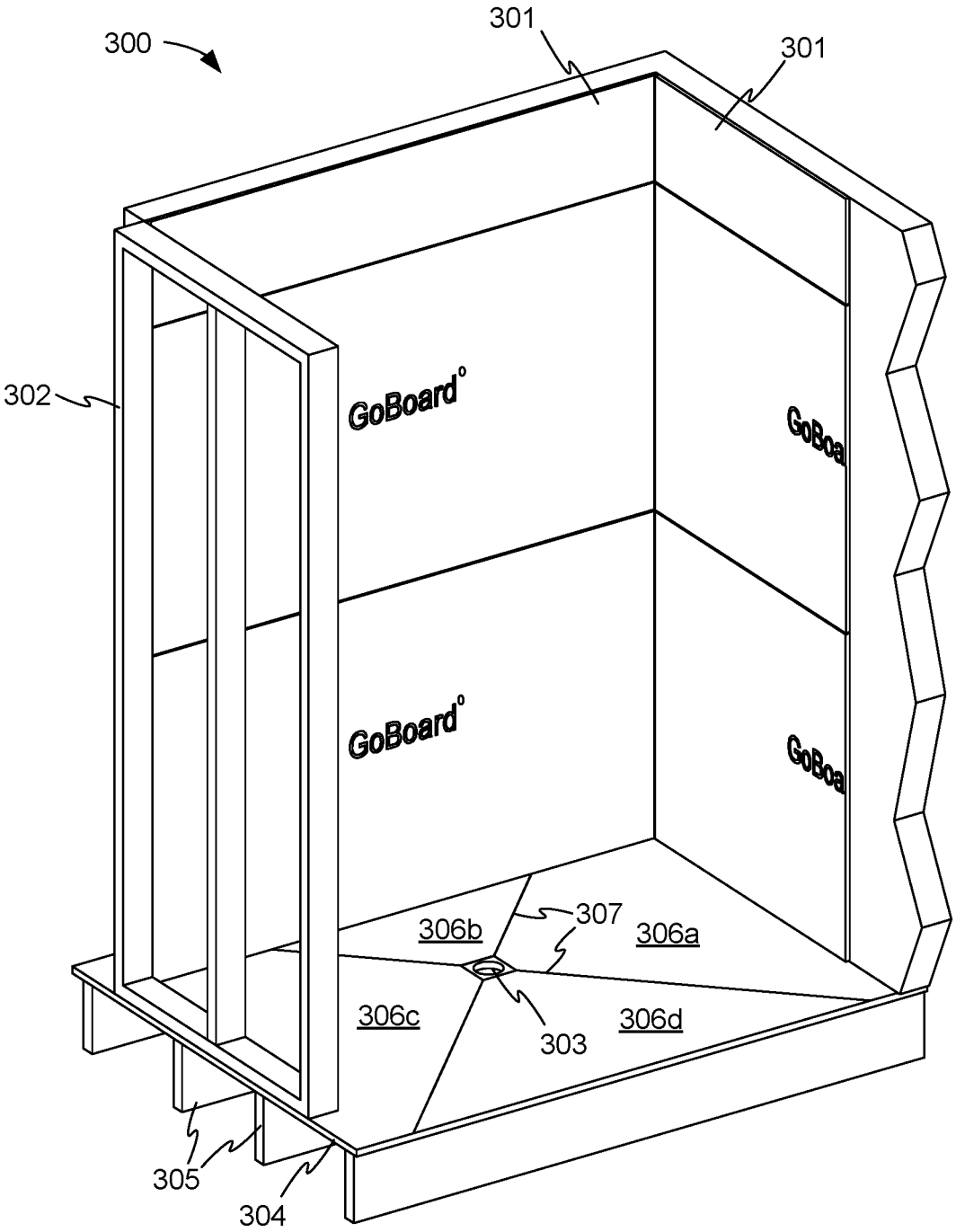
FIG. 3 illustrates a stage in a process of fabricating a shower stall, in accordance with embodiments of the invention.

FIG. 3 illustrates a stage in a process of fabricating a shower stall 300, in accordance with embodiments of the invention. Walls 301 of shower stall 300 have already been faced with waterproof backer boards, in this case is GoBoard® boards available from Johns Manville. In other embodiments, other kinds of backer boards may be used to face walls 301. In FIG. 3, no facing is shown on end wall 302 for ease of visualization of the interior of shower stall 300, but it will be understood that end wall 302 will also be faced in the completed shower stall.

Unlike shower stall 100 described above, the drain 303 in shower stall 300 is centered within the stall. However, embodiments of the invention may accommodate many different drain positions. In this example, a square drain cover will be used, but round drain covers or covers of other shapes may be used in other embodiments, some of which are described below.

Floor sheeting 304 is visible in FIG. 3, resting on floor joists 305. In other embodiments, a shower stall embodying the invention may be installed over a concrete or other kind of floor.

The floor area of shower stall 300 is conceptually divided into four regions **306*a*-306*d*, defined by the outer walls of shower stall 300 and by diagonal lines 307 emanating from drain 303. Lines 307 may be conveniently marked on floor sheeting 304, although this is not necessary. Each of the regions 306*a*-306*d* will receive a portion of a wedge panel such as wedge panel 201**.

Lines 307 should preferably be at right angles to each other, and when a square or rectangular drain cover is being used, should emanate at 45-degree angles from the drain cover corners. In the case of a round drain, lines 307 should still be at right angles to each other, but can be oriented in any direction within the shower stall. The orientation shown in FIG. 3 is convenient and may be preferred.

Figure 4:
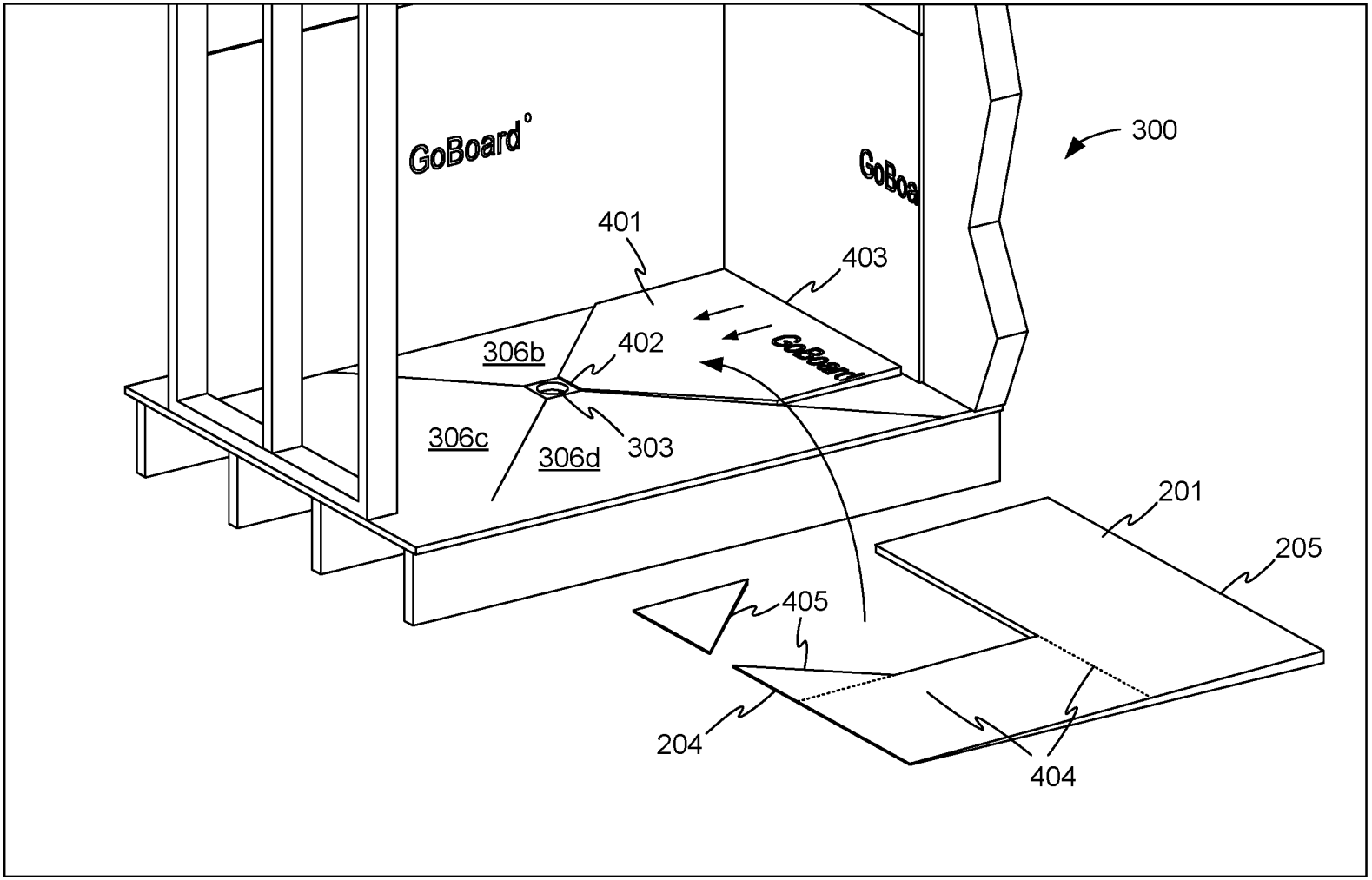
FIG. 4 illustrates extraction a wedge panel portion and its placement in a shower stall, in accordance with embodiments of the invention.

To form the shower pan, segments of wedge panels such as wedge panel 201 are cut to fit regions **306*a*-306*d*. FIG. 4 illustrates placement of a wedge panel portion 401 in region 306*a*. Wedge panel portion 401 is cut from wedge panel 201 as shown, to fit region 306*a*, with narrow edge 402 being taken from narrow edge 204 of wedge panel 210, and thicker edge 403 being taken from a thicker area of wedge panel 201. Wedge panel portion 401 may be conveniently extracted from wedge panel 201 by scoring and breaking wedge panel 201 along dashed lines 404, as well as along diagonal edges 405, similar to the way that drywall board is commonly cut to size. However, any workable technique for cutting wedge panel portion 401 from wedge panel 201 may be used, for example sawing or slitting. The unused portions of wedge panel 201** may be discarded, recycled, or possibly used to fill smaller areas in other shower installations on the job.

Once in place, wedge panel portion 401 creates a sloped surface that is lowest at drain 303.

Figure 5:
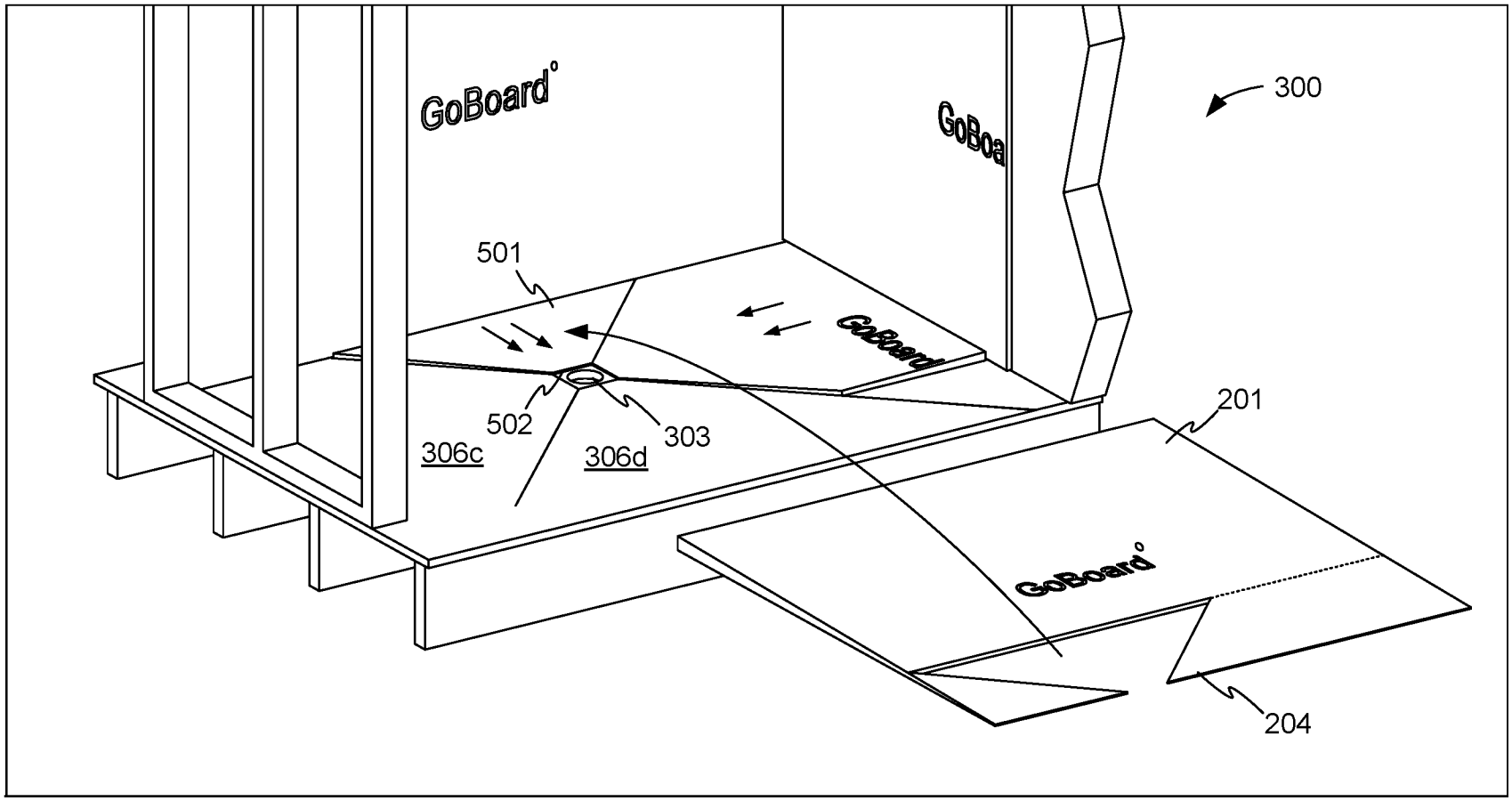
FIG. 5 illustrates extraction and placement of another wedge panel portion, in accordance with embodiments of the invention.

Similarly, FIG. 5 illustrates extraction of another wedge panel portion 501 for placement in region **306*b*. Again, narrow edge 502 of wedge panel portion 501 is taken from narrow edge 204 of wedge panel 201, and placed next to drain 303, such that the top surface of wedge panel portion 501 slopes toward drain 303**.

Figure 6:
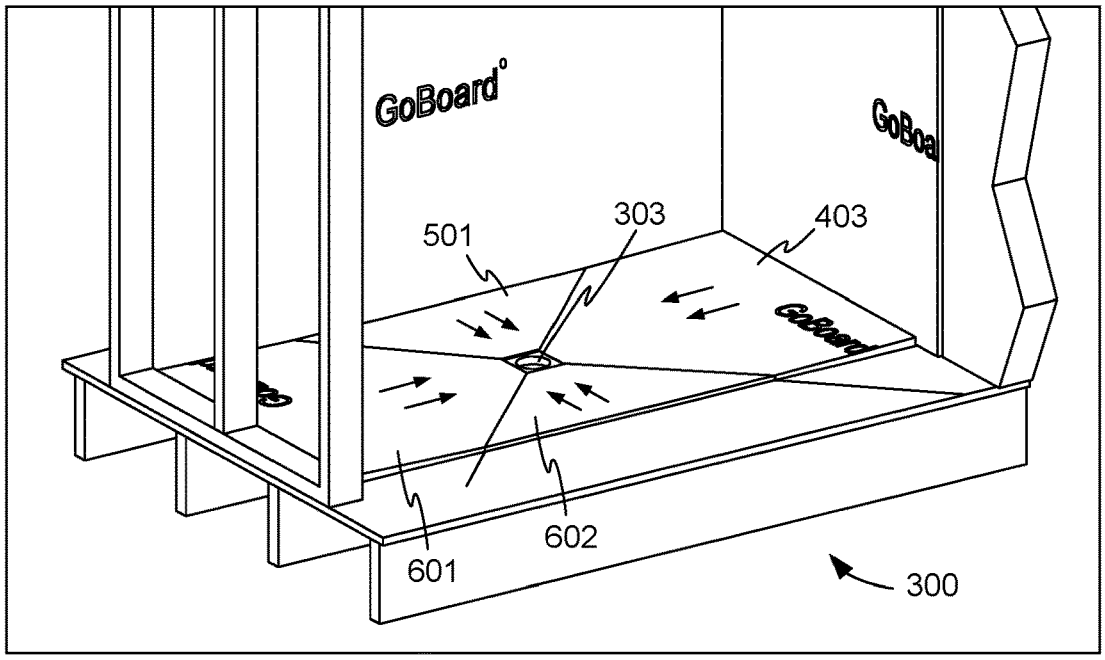
FIG. 6 illustrates placement of other wedge panel portions, in accordance with embodiments of the invention.

Wedge panel portions are similarly cut and placed in regions **306*c* and 306*d*, as shown in FIG. 6. In addition to wedge panel portions 402 and 501, previously placed in regions 306*a* and 306*b*, wedge panel portions 601 and 602 have been placed in regions 306*c* and 306*d*. The top surfaces of all four wedge panel portions 402, 501, 601, and 602 slope toward drain 303. Because the angled cuts used to form the wedge panel portions are at 45 degrees from the edges of wedge panel 201 (or more precisely, at 45 degrees from the strike and dip directions of the upper major surface of the wedge panel), the angled edges of adjacent wedge panel portions 402, 501, 601, and 602** have the same shape and match smoothly together.

Figure 7:
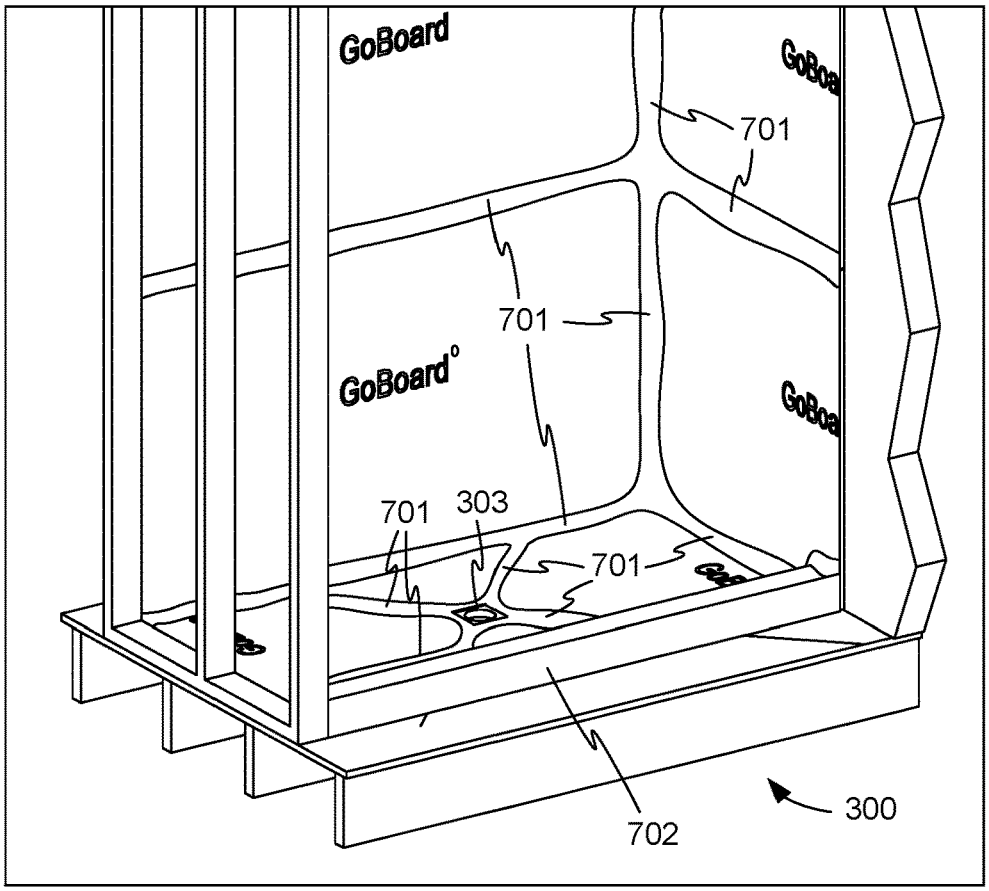
FIG. 7 shows another step in the fabrication of the shower stall.

FIG. 7 shows another step in the fabrication of the shower stall. All joints between the wall and pan panels are sealed with a suitable tape or sealant 701, or a combination of sealing mechanisms, producing a fully waterproof installation preferably compliant with ANSI 118.10 and PS-106. While any workable sealants or tapes may be used, a preferred sealant is polyurethane caulk. A preferred seam tape is 2" wide polymer-coated alkali-resistant fiber glass mesh tape. Joints may also be coated with a liquid waterproofing membrane. In some embodiments, the sealant may be GoBoard® Sealant available from Johns Manville. Preferably, a gap of about ⅛ inch is left between all adjacent panels, for filling with sealant, to facilitate proper sealing of the shower stall.

In FIG. 7, a curb 702 has also been placed at the opening of the shower stall. Curb 702 may help keep water inside the shower stall, but it is to be understood that curbless showers are also possible and can be constructed in accordance with embodiments of the invention. Curb 702 may be made of materials similar to those of the wedge and wall panels, for example a foam core having a high tensile strength facer, treated for compatibility with mortars and adhesives. In other embodiments, an unfaced curb may be used, and may be treated or worked to enhance its compatibility with adhesives, sealants, thinset mortars, and the like.

Once any sealant is dried or cured, the shower stall may be tiled or provided with another suitable finish layer, according to usual practice. Drain 303 may be sealed in any suitable way, for example using a membrane that overlaps wedge panel portions 402, 501, 601, and 602. More details about installation and sealing of a shower stall may be found in the document "GoBoard® Point Drain Installation Instructions", available from Johns Manville. A shower embodying the invention can be installed over wooden subfloors, concrete slabs, and wall framing using standard tools and typical setting materials and installation methods employed by tile installers.

Figure 8A:
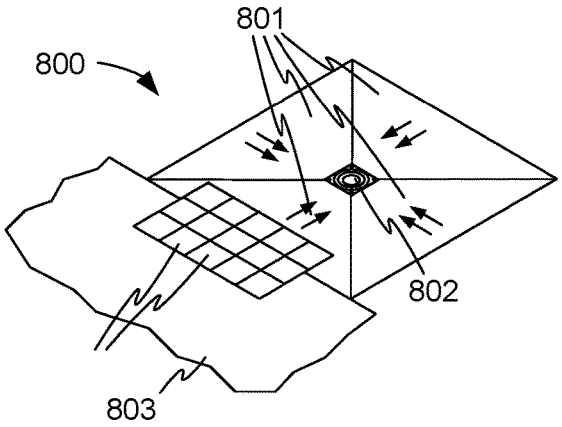
FIGS. 8A-8C illustrate a curbless shower installation, in accordance with embodiments of the invention.
Figure 8B:
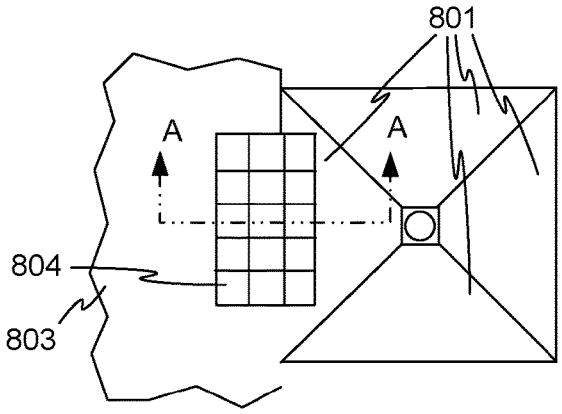
Figure 8C:
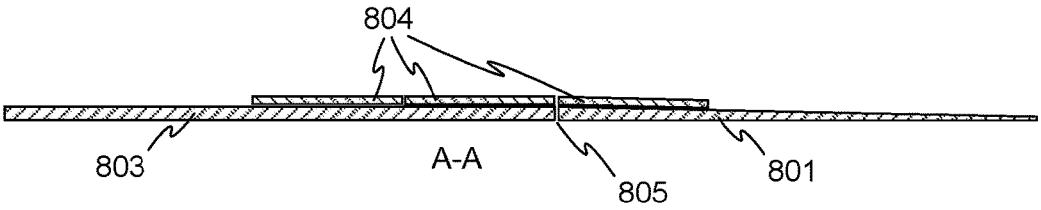

Using the basic techniques described above, a wide variety of shower stalls may be fabricated in accordance with embodiments of the invention. For example, FIGS. 8A-8C illustrate a curbless shower installation 800. In addition to being curbless, shower installation 800 is suitable for a square shower stall, rather than rectangular. For ease of explanation, the walls of shower installation 800 are not shown, but they may be fabricated similarly to the walls of shower stall 300 described above.

In shower installation 800, four wedge panel portions 801 are arranged as described above, so that each slopes downward toward drain 802. A non-wedge-shaped backer board 803 is preferably laid with one edge adjacent one of wedge panel portions 801, outside the shower stall, and at the entrance to the shower stall. Preferably, the thickness of backer board 803 is the same or nearly the same as the thickness of the edge of the adjacent wedge panel portion 801 where the two meet. Backer board 803 is preferably made of the same materials as the wedge panel portions 801. Sealants are excluded from FIGS. 8A-8C for ease of visualization.

FIG. 8B shows a plan view of the installation, and FIG. 8C shows a section view of the joint between backer board 803 and the adjacent wedge panel portion 801. Tile 804 (only partially shown) can be laid on backer board 803 and on wedge panel portions 801, to finish the shower stall. Preferably, a tile joint is placed coincidentally with joint 805 between backer board 803 and wedge panel portion 801, to transition from the horizontal floor outside the shower stall and the sloped pan inside the shower stall.

Figure 9:
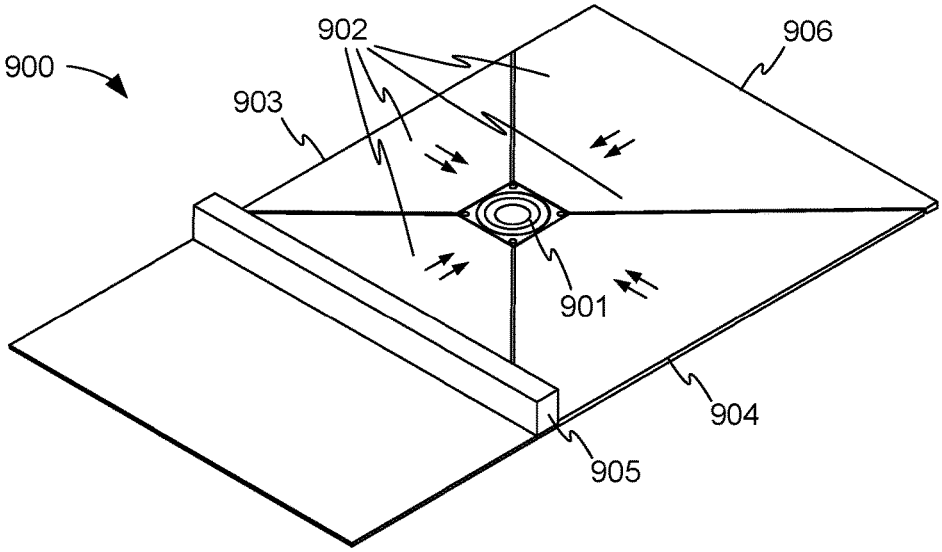
FIG. 9 illustrates a shower installation in accordance with embodiments of the invention, in which the drain is not centered within the shower pan.

FIG. 9 illustrates a shower installation 900 in accordance with embodiments of the invention, in which drain 901 is not centered within the shower pan. This situation may especially arise in a remodeling context, for example where a shower is being enlarged, but the drain cannot be moved. The shower walls are not shown in FIG. 9. In installation 900, the shower pan is formed by wedge panel portions 902, as shown, cut to accommodate the non-centered drain 901. Drain 901 is closer to edge 903 than to edge 904, and is closer to curb 905 than to edge 906.

While shower installation 900 includes a curb 905, an offset-drain curbless installation is possible and readily realized using similar techniques. For both curbed and curbless installations, offset drain locations can easily be accommodated avoiding costly drain relocations or subfloor modifications because the oversize wedge panels can be cut to size onsite as shown in FIG. 9. This significantly reduces the time and cost required to construct a tileable waterproof tile installation complying with ANSI 118.10 (standard for waterproof membranes used to install thinset ceramic tile and dimensional stone) and IAMPO PS-106 (standard for tileable shower receptors and shower kits).

Figure 10:
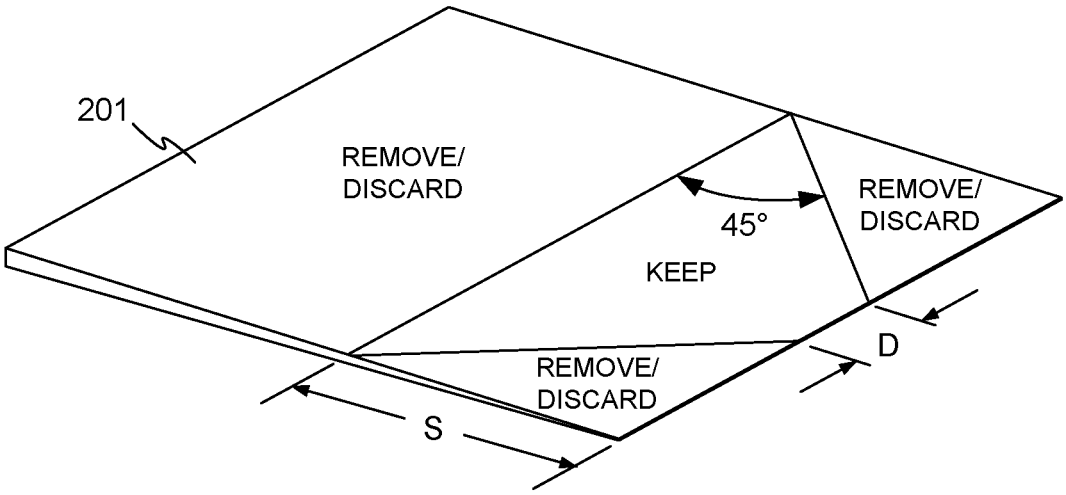
FIGS. 10 and 11 demonstrate how to cut four 48"×48" wedge panels to produce a 48"×48" square shower pan with a centered point drain, in accordance with embodiments of the invention.
Figure 11:
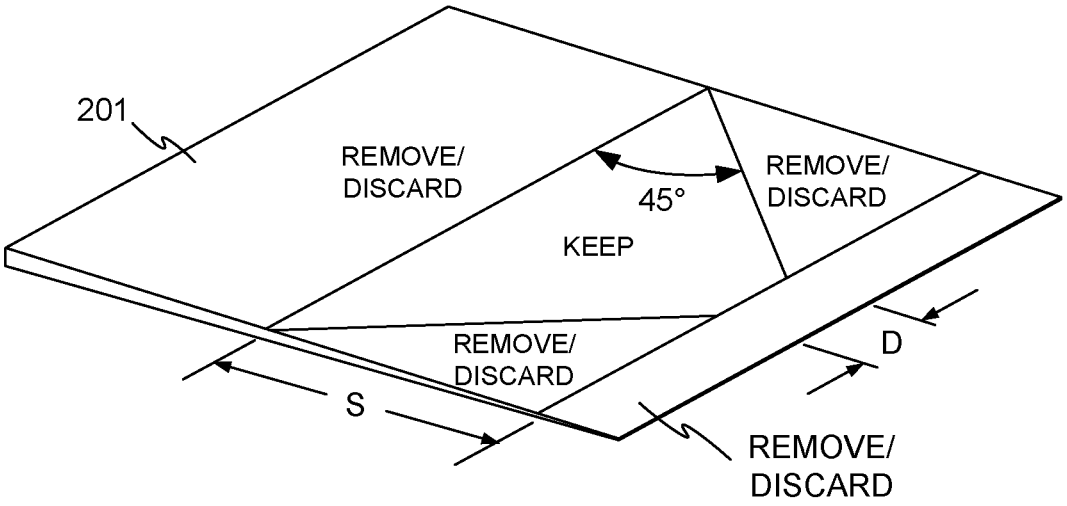

FIGS. 10 and 11 demonstrate how to cut four 48"×48" wedge panels such as wedge panel 201 to produce a 48"×48" square shower pan with a centered point drain, in accordance with embodiments of the invention. In the figures, "D" is the width of the drain cover or clamping collar. Distance "S" is the distance from the drain cover to the outer perimeter of the shower pan. Because the wedge panels are oversized, the system is very accommodating to different style point drains. Round point drains can also be accommodated using a similar cutting procedure except the wedge panels are cut to a point and then a circular cutout for the round drain is completed with the four wedge panels dry fitted in the shower pan area.

Depending on the drain flange or drain clamping collar thickness, the installer may need to cut the panels to produce a thicker edge near the drain as shown in FIG. 11. This technique may also be used to match the thickness of a wedge panel portion with the thickness of adjacent backer boards if needed, for example in a curbless installation such as shower installation 800 shown in FIGS. 8A-8C.

Figure 12:
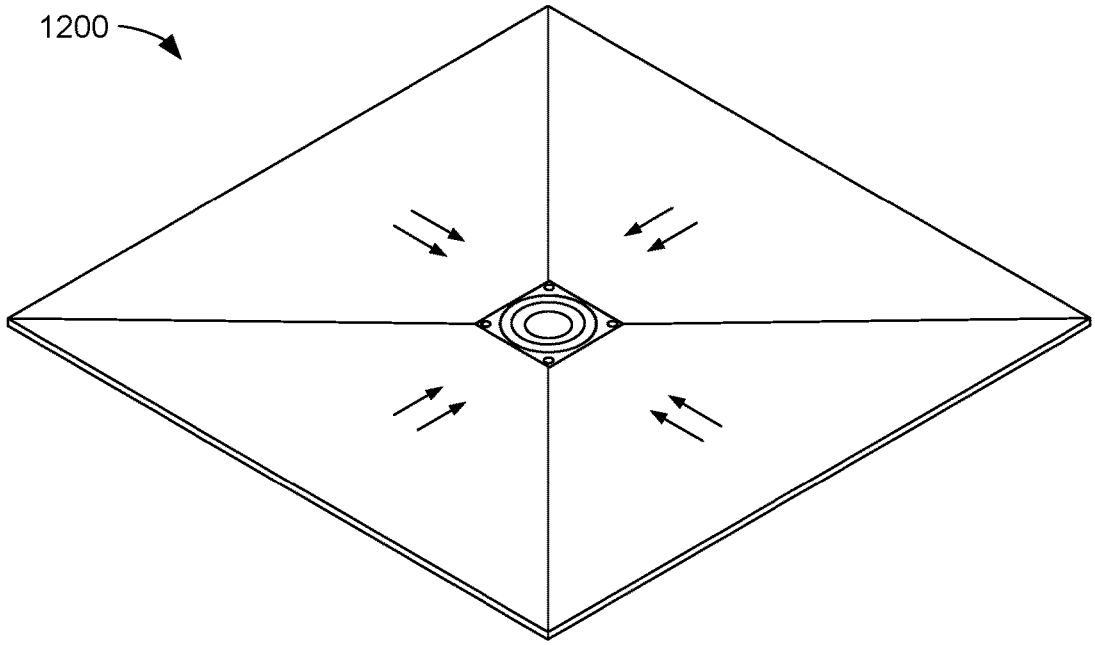
FIG. 12 shows the layout of a square shower pan using the four identical wedge panel portions of FIG. 10 or FIG. 11.

FIG. 12 shows the layout of a square shower pan 1200 using the four identical wedge panel portions of FIG. 10 or FIG. 11, installed with a square point drain. Using wedge panels of 24×48 or 48×48 inches, shower pan 1200 may be up to 48×48 inches, or slightly larger (assuming that the drain is centered in the shower pan area). Using larger wedge panels, 48×96 inches for example, enables the fabrication of shower pans up to 96×96 inches or slightly larger, depending on the shape (round or square) and size of the point drain used. For smaller shower pan areas, wedge panels are cut to smaller sizes using method shown in FIG. 10 or FIG. 11.

Figure 13:
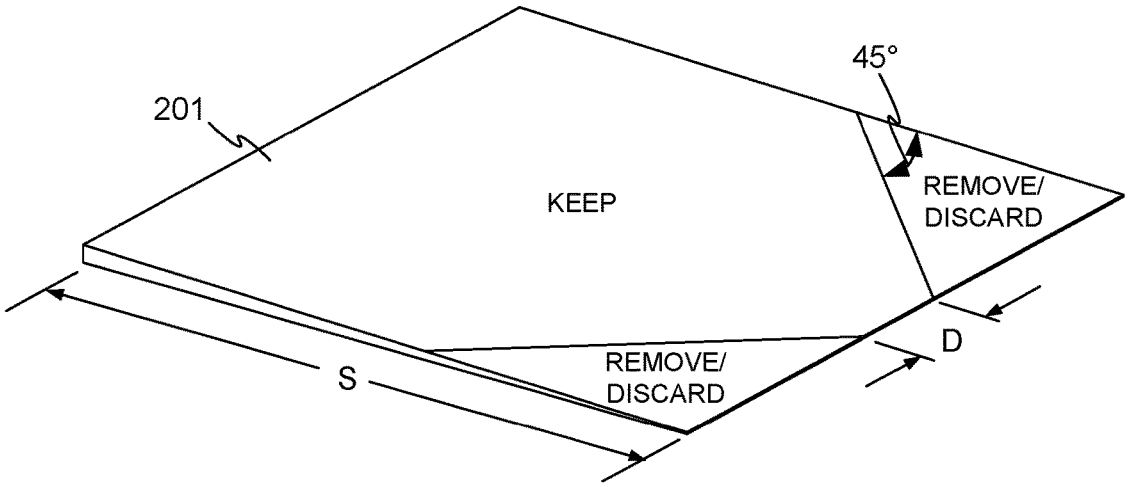
FIG. 13 illustrates cutting a 48×48 inch wedge panel to form a rectangular shower pan up to 48×96 inches, in accordance with embodiments of the invention.
Figure 14:
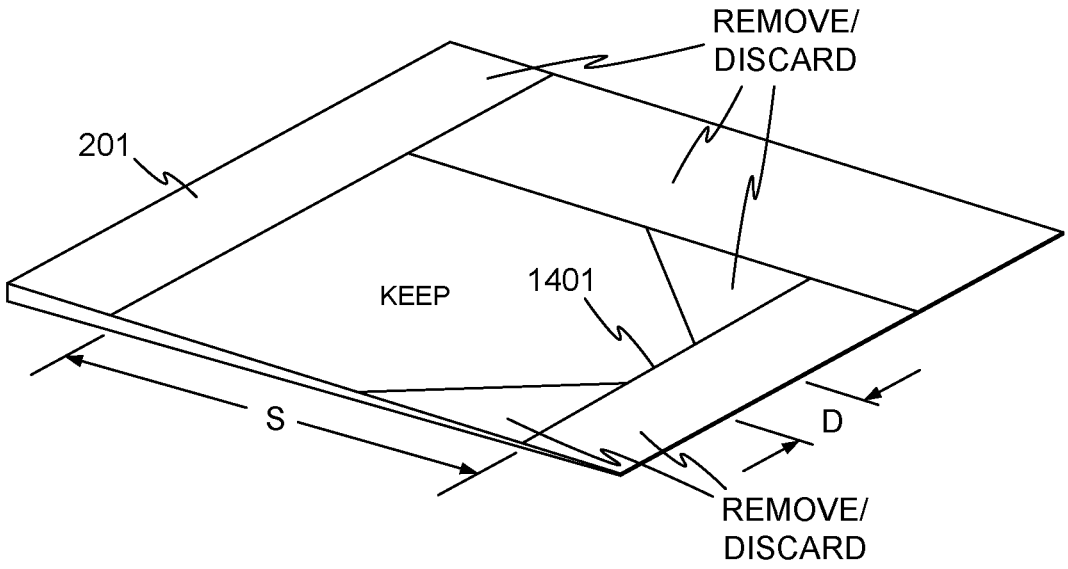
FIG. 14 shows cutting of a wedge panel portion to form a rectangular shower pan somewhat smaller than 48×96 inches, in accordance with embodiments of the invention.
Figure 15:
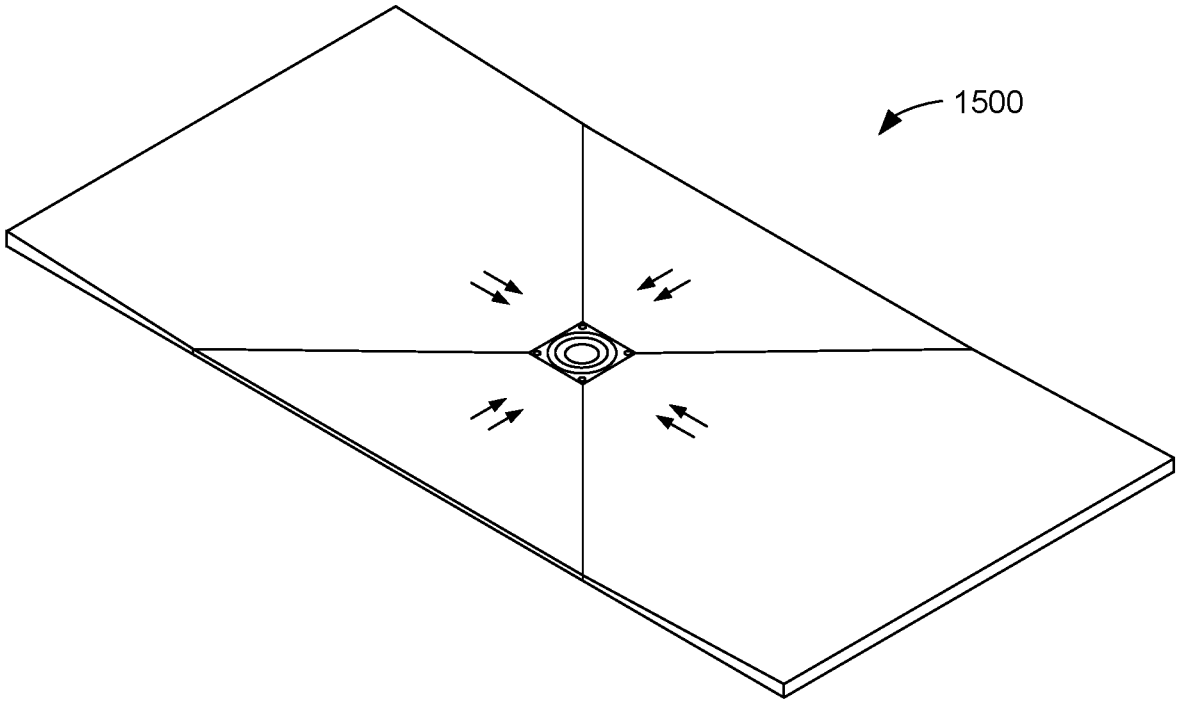
FIG. 15 shows the panels cut as in FIG. 13, arranged into a 48×96 inch shower pan.

Wedge panels can also be cut to accommodate rectangular shaped shower pan areas with centered point drains of varying sizes. FIG. 13 illustrates cutting a 48×48 inch wedge panel 201 to form a rectangular shower pan up to 48×96 inches, in accordance with embodiments of the invention. As before, distance "D" is the width of the drain cover or clamping collar, and distance "S" is the distance from the drain cover to the outer perimeter of the shower pan. FIG. 14 shows cutting of a wedge panel portion to form a rectangular shower pan somewhat smaller than 48×96 inches, in accordance with embodiments of the invention. In the example of FIG. 14, edge 1401 is also set back from the edge of the raw panel, for example to accommodate a thicker drain cover. FIG. 15 shows the panels cut as in FIG. 13, arranged into a 48×96 inch shower pan.

Embodiments of the invention can also be used to create shower pans of other shapes. While the shower pans described thus far are square or rectangular, other shapes are possible, including round, elliptical, other polygonal shapes, or freeform shapes. In some embodiments, such shower pan shapes can be accomplished by simply trimming the wedge panel portions to fit the desired perimeter, while the wedge panels meet the drain in the same manner is in a square or rectangular shower pan.

FIGS. 16-23 illustrate a technique for cutting wedge panel portions for an installation with a rectangular pan, but with the drain not centered in the pan, in accordance with embodiments of the invention. Using this method, installers can quickly fabricate shower pans onsite which would normally require more expensive, specially pre-fabricated shower pans. The method shown eliminates the need for complex measurements since the 45 degree angle cuts required can be referenced from the drain clamping collar and simply marked on the wedge panels using a straight edge. The installer than cuts the excess wedge panel material off with a utility knife or other means.

Figure 16:
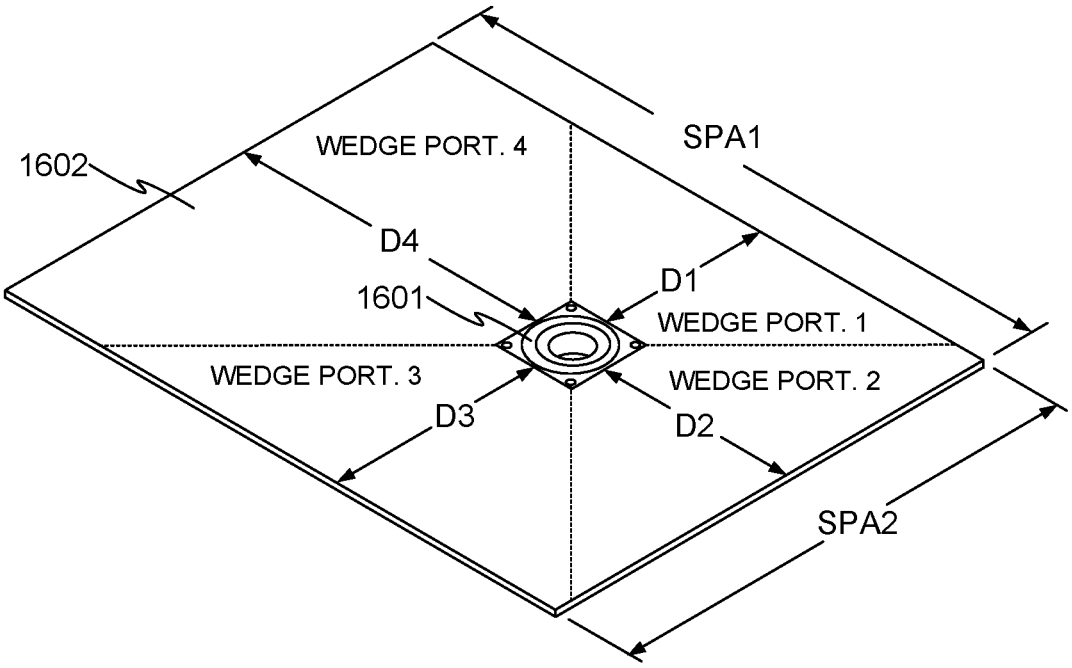
FIG. 16 shows the initial layout of a rectangular shower pan area with a drain not centered in the shower pan, in accordance with embodiments of the invention.

FIG. 16 shows the initial layout of the shower pan area. The length of the shower pan is SPA1, and the width is SPA2. Square point drain 1601 is anchored to floor 1602 with its sides parallel to the edges of the rectangular shower pan area. Drain 1601 is not centered within the shower pan area, so that D1<D3 and D2<D4. Four wedge panel portions will be needed, having initial outer dimensions as follows:

Wedge portion 1: D1×SPA1

Wedge portion 2: D2×SPA2

Wedge portion 3: D3×SPA1

Wedge portion 4: D4×SPA2

Figure 17:
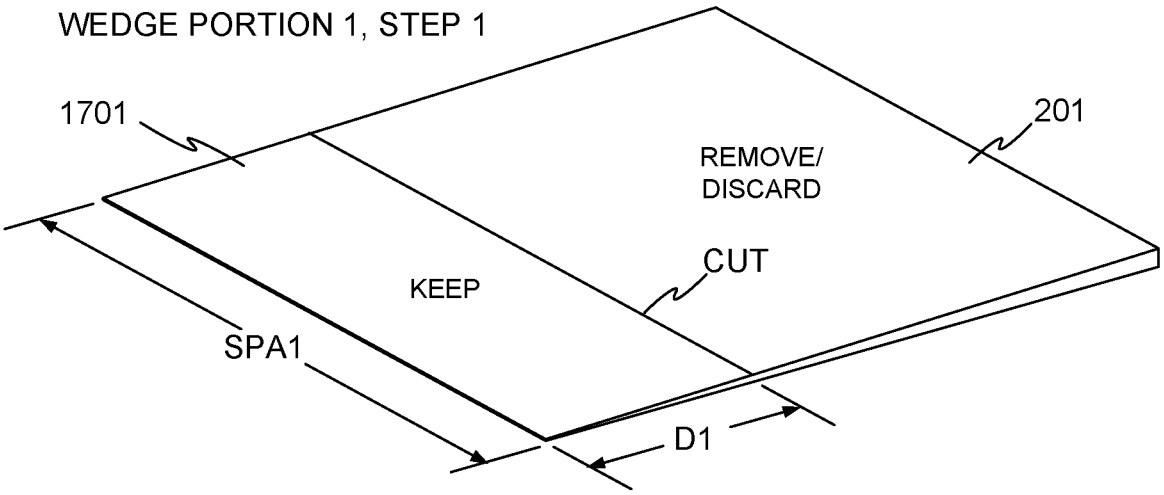
FIG. 17 illustrates the cutting of a rectangular piece from a wedge panel, in a method according to embodiments of the invention.

FIG. 17 illustrates the cutting of a rectangular piece 1701 from a wedge panel such as wedge panel 201. Rectangular piece 1701 will eventually become wedge portion 1 shown in FIG. 16.

Figure 18:
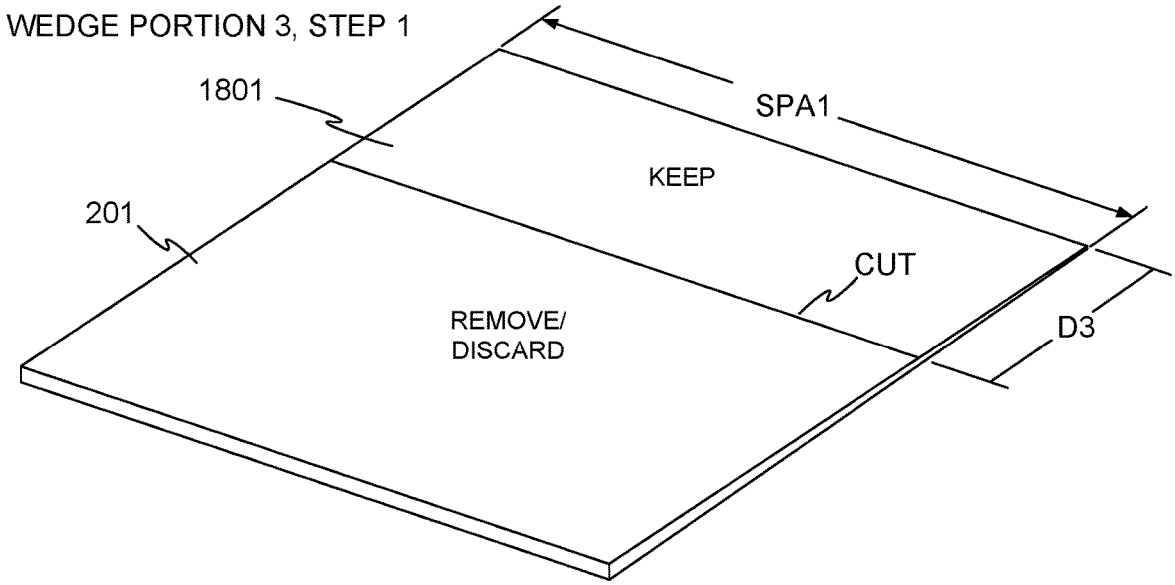
FIG. 18 illustrates the cutting of another rectangular piece.

FIG. 18 illustrates the cutting of a rectangular piece 1801 from a wedge panel such as wedge panel 201. Rectangular piece 1801 will eventually become wedge portion 3 shown in FIG. 16.

Figure 19:
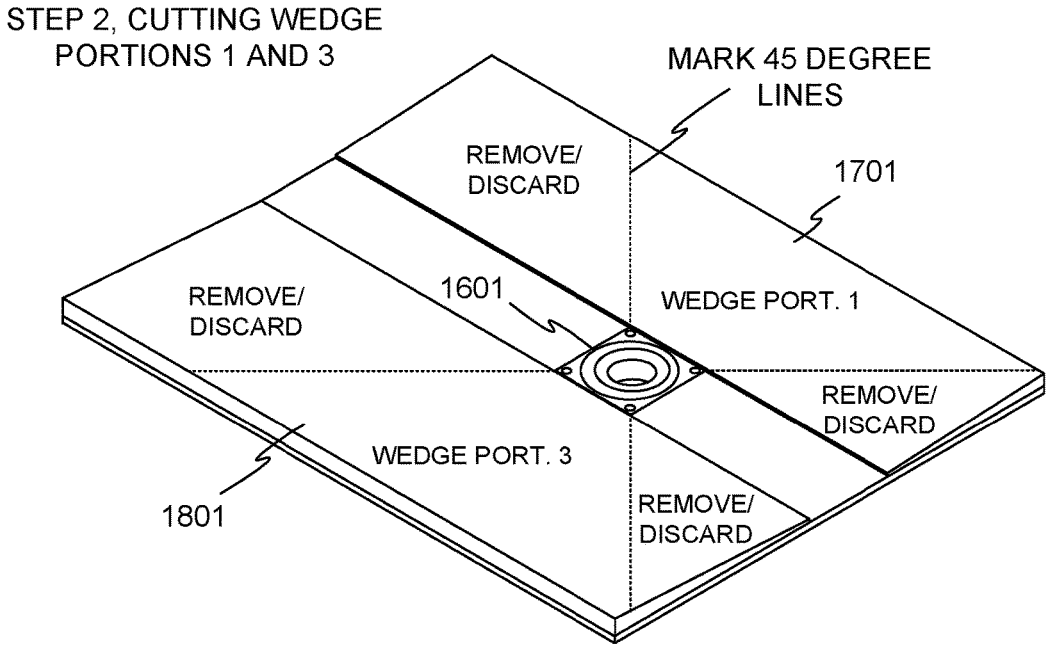
FIG. 19 shows the marking and cutting of wedge portions from the rectangular pieces of FIGS. 17 and 18.

FIG. 19 shows the marking and cutting of wedge portions 1 and 3. Rectangular pieces 1701 and 1801 are placed in the shower pan area with their thin edges adjacent to drain 1601. Using a straightedge, cutting lines are marked using the corners of the square drain fitting as a guide. Rectangular pieces 1701 and 1801 are cut along the marked lines, and become wedge portions 1 and 3.

Figure 20:
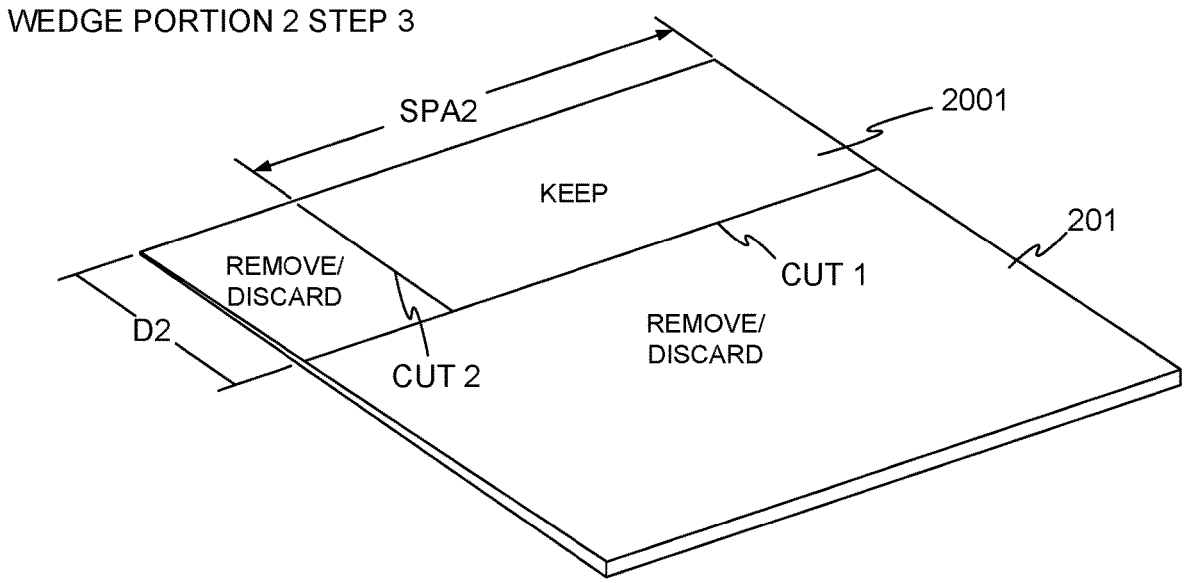
FIG. 20 illustrates the cutting of another rectangular piece.

FIG. 20 illustrates the cutting of a rectangular piece 2001 from a wedge panel such as wedge panel 201. Rectangular piece 2001 will eventually become wedge portion 2 shown in FIG. 16.

Figure 21:
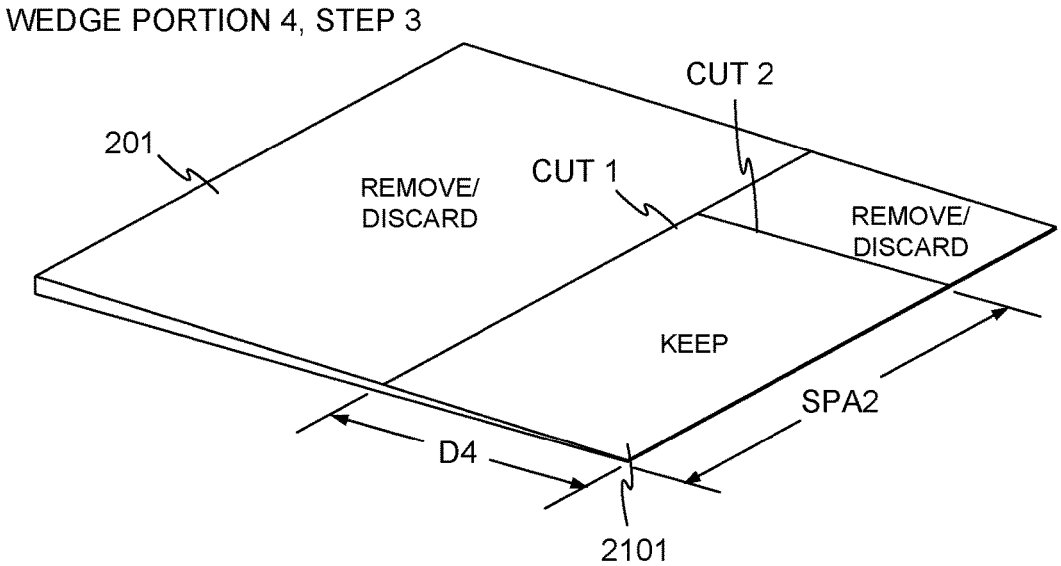
FIG. 21 illustrates the cutting of another rectangular piece.

FIG. 21 illustrates the cutting of a rectangular piece 2101 from a wedge panel such as wedge panel 201. Rectangular piece 2101 will eventually become wedge portion 4 shown in FIG. 16.

Figure 22:
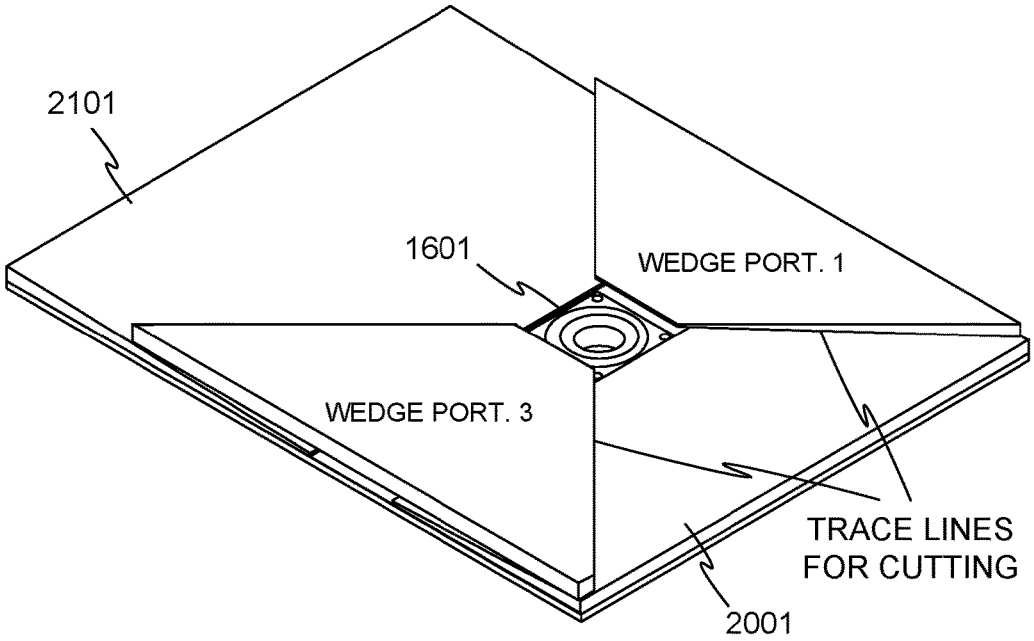
FIG. 22 shows the marking of wedge portions from the rectangular pieces of FIGS. 20 and 21.

FIG. 22 illustrates the marking of wedge portions 2 and 4. Rectangular pieces 2001 and 2101 are placed in the shower pan area with their thin edges adjacent to drain 1601. Previously-cut wedge portions 1 and 3 are place over rectangular pieces 2001 and 2101, in their correct positions. The angled edges of wedge portions 1 and 3 can be used to trace cutting lines on rectangular pieces 2001 and 2101.

Figure 23:
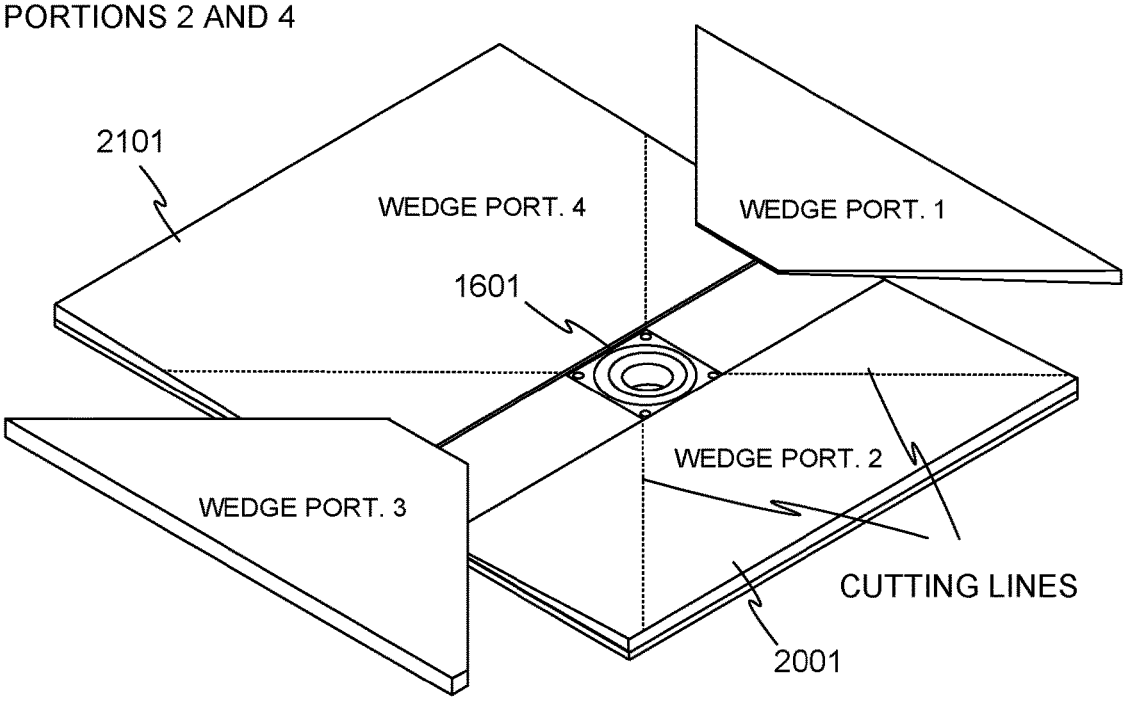
FIG. 23 shows the cutting of wedge portions from the rectangular pieces of FIGS. 20 and 21.

As shown in FIG. 23, wedge portions 1 and 3 can then be removed, and rectangular pieces 2001 and 2101 are cut along the traced lines to form wedge portions 2 and 4.

Figure 24:
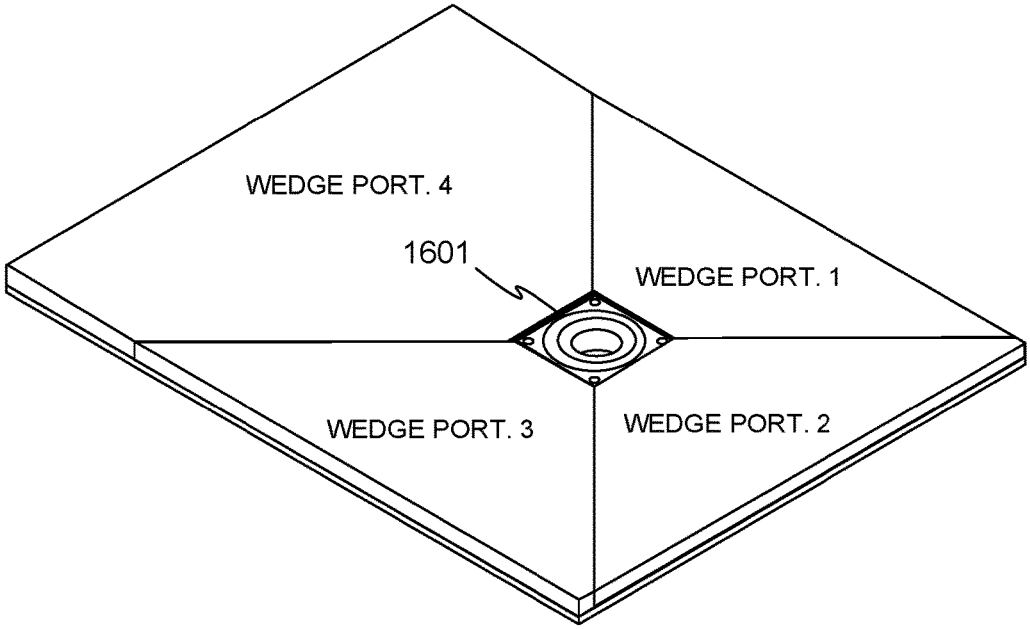
FIG. 24 shows the wedge portions of FIGS. 19 and 23 in place in the shower pan area.

FIG. 24 shows wedge portions 1-4 in place in the shower pan area. The shower pan would then be sealed and finished as described above. As with the center drain position, cut wedge panels are adhered together and all joints sealed with either a suitable sealant or seam tape producing a fully waterproof installation compliant with ANSI 118.10 and PS-106. While any workable sealants or tapes may be used, a preferred sealant is polyurethane caulk. A preferred seam tape is 2" wide polymer-coated alkali-resistant fiber glass mesh tape. Joints may also be coated with a liquid waterproofing membrane.

Figure 25:
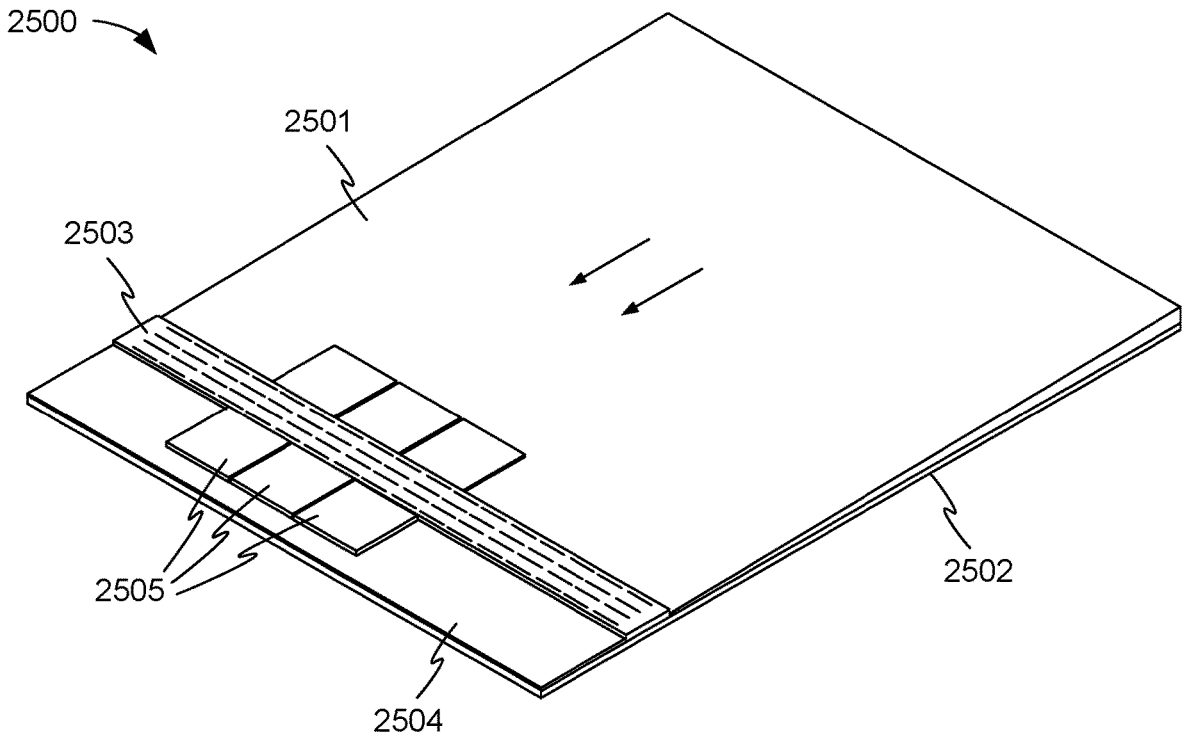
FIG. 25 shows a curbless shower installation in accordance with embodiments of the invention.

Linear drain shower pans, both curbed and curbless, can also be created with the wedge panels as shown in FIG. 25. In FIG. 25, a curbless shower installation 2500 includes a wedge panel 2501 placed on top of flooring 2502 and sloped toward a linear drain 2503. A backer board 2504 is placed outside the shower stall, and the stall and a portion of the room outside the shower stall are finished with tile 2505 or another suitable finish. While the arrangement of FIG. 25 is a curbless installation, embodiments of the invention may also be used to fabricate a shower installation using a linear drain and a curb.

Figure 26:
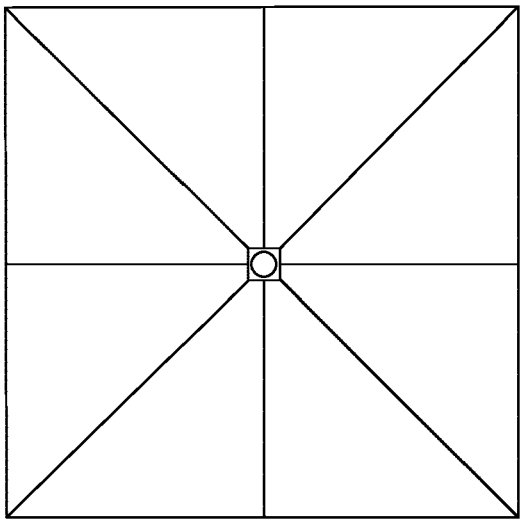
FIG. 26 illustrates a layout for a shower up to 96×96 inches, in accordance with embodiments of the invention, fabricated using eight 48×48 inch wedge panels.
Figure 27:
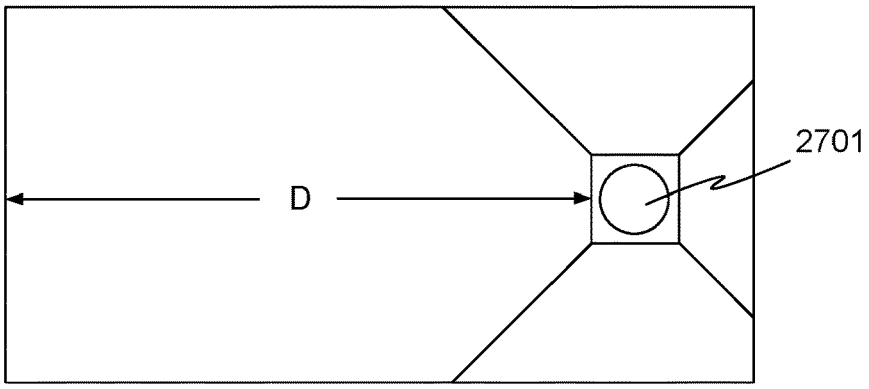
FIG. 27 illustrates a layout for a shower having its drain offset far from the center of the shower, in accordance with embodiments of the invention.
Figure 28:
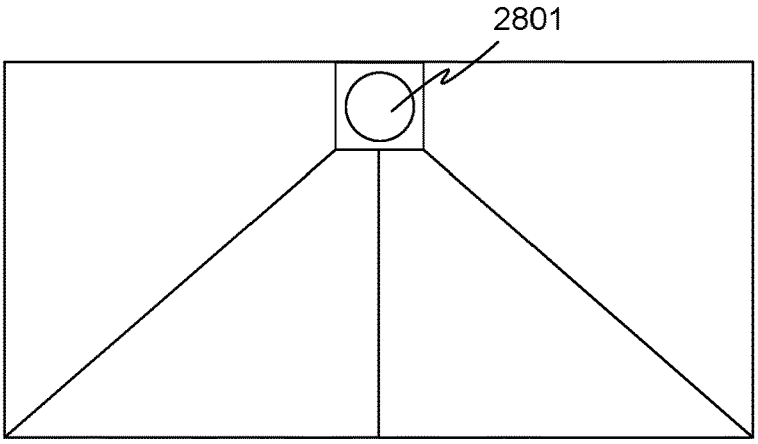
FIG. 28 illustrates a layout for a shower having its drain at one long edge of the shower stall, in accordance with embodiments of the invention.

Shower pans of almost any size and configuration may be fabricated on site with relatively low material and labor costs. For example, FIG. 26 illustrates a layout for a shower up to 96×96 inches, fabricated using eight 48×48 inch wedge panels. FIG. 27 illustrates a layout for a shower having its drain 2701 offset far from the center of the shower, as may be the case where a bathtub is being replaced with a walk-in shower in a remodel project. The layout of FIG. 27 may be fabricated using three 48×48 inch wedge panels, so long as distance "D" is about 48 inches or smaller. FIG. 28 illustrates a layout for a shower having its drain 2801 at one long edge of the shower stall. The layout of FIG. 28 may be fabricated using four 48×48 inch wedge panels.

Figure 29:
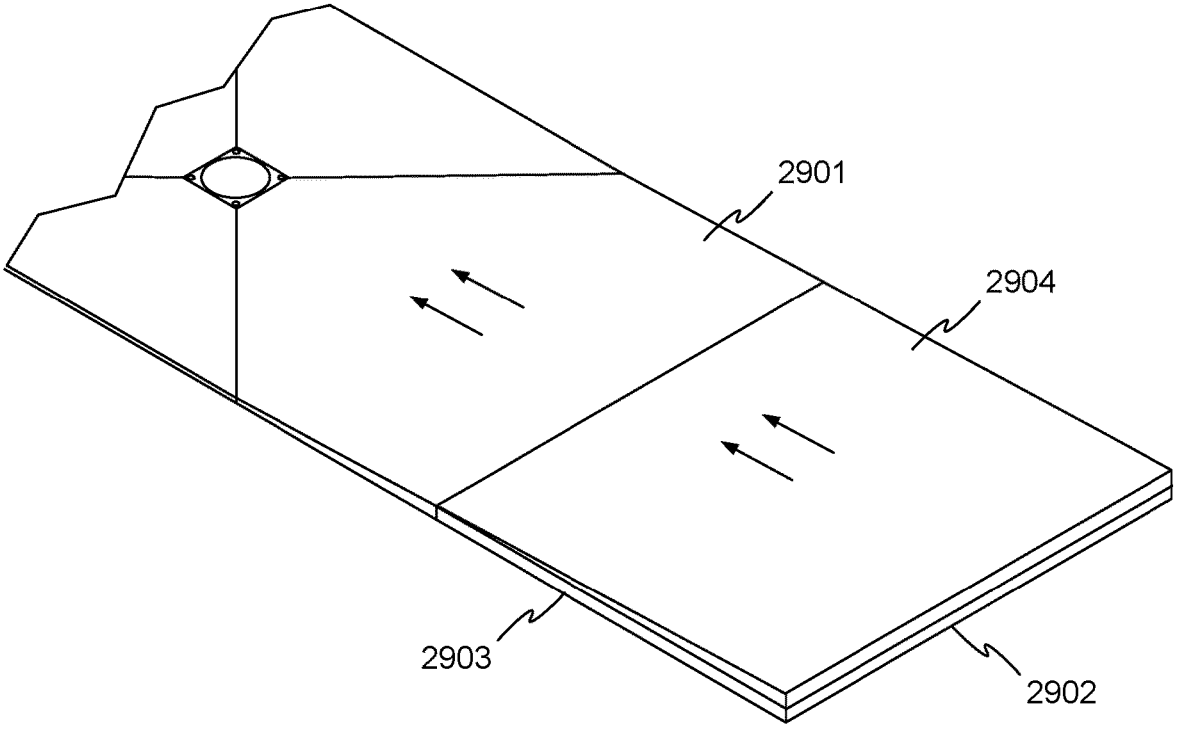
FIG. 29 illustrates one technique for using wedge panels to fabricate larger showers, in accordance with embodiments of the invention.

Other, even larger shower sizes are possible, for example for fabricating a shower for an athletic facility. In all of the layouts described above, all of the wedge portions have an edge adjacent the drain. If this were a requirement, the size of shower that could be constructed would be limited to about twice the linear dimensions of the wedge panels. FIG. 29 illustrates one technique for using wedge panels to fabricate larger showers, in accordance with embodiments of the invention. Only a portion of the installation is shown, but it will be understood that the technique can be extended to other parts of a shower installation.

In FIG. 29, wedge portion 2901 is not large enough to reach the outer edge 2902 of the shower stall. To extend the shower pan, a flat backer board 2903 of an appropriate thickness is placed on the subfloor beyond the edge of wedge portion 2901, and another wedge panel 2904 placed on top of flat backer board 2903. Wedge portions 2901 and 2904 thus form a continuous sloped surface extending beyond the reach of wedge portion 2901 alone. Backer board 2903 may be made of the same materials as the wedge panels, or a different material. In some embodiments, to facilitate the transition, wedge portion 2901 may be cut at a location that makes its thick edge the same thickness as backer board 2903.

For the purposes of this disclosure, for two adjacent panels to form a continuous surface means that the edges of the two panels nominally match, without abrupt changes in height between the upper surfaces of the panels. Horizontal gaps between the panels do not render the surface discontinuous.

Figure 30:
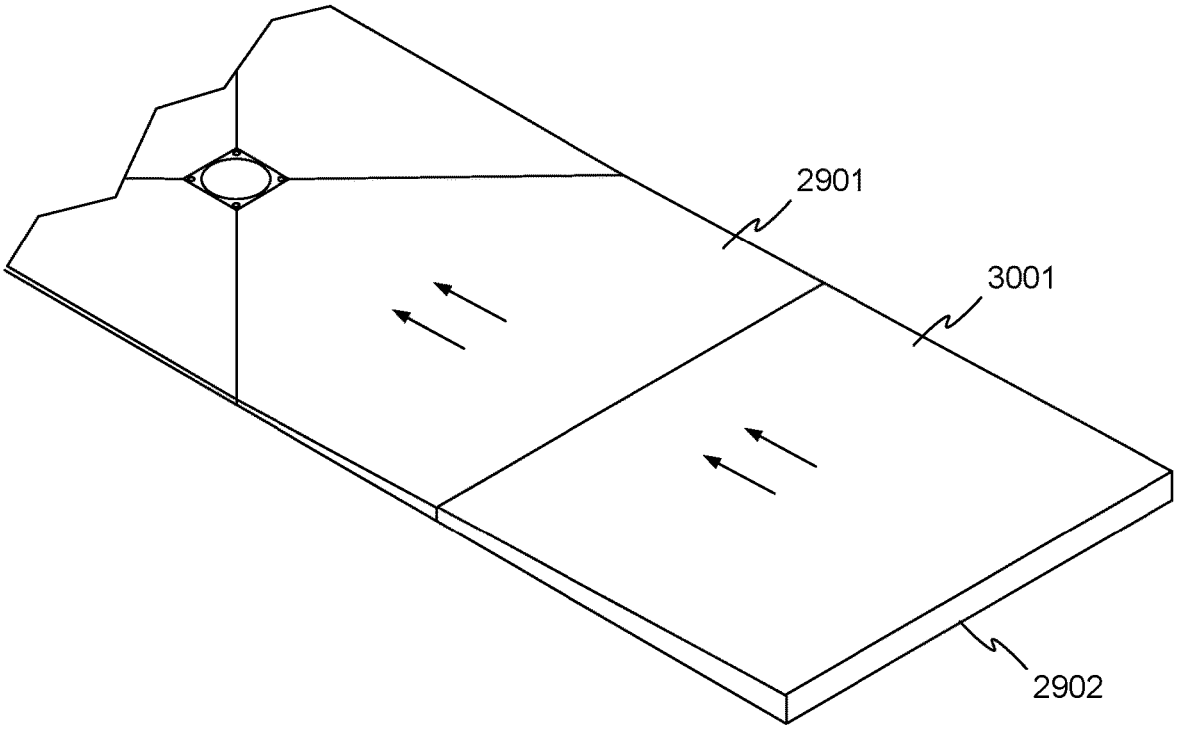
FIG. 30 illustrates another technique for using wedge panels to fabricate larger showers, in accordance with other embodiments of the invention.

FIG. 30 illustrates another technique for using wedge panels to fabricate larger showers, in accordance with other embodiments of the invention. As in FIG. 29, wedge portion 2901 is not large enough to reach the outer edge 2902 of the shower stall. In the embodiment of FIG. 30, a thicker wedge panel 3001 is available, and is placed beyond wedge portion 2901 to complete the shower pan. The top surfaces of wedge portions 2901 and 3001 thus form a continuous surface sloped toward the drain without the need for any additional backer board. Wedge panels may be fabricated in a number of thicknesses to facilitate the construction of shower stalls of nearly any size. In addition, the technique of FIG. 11 may be used to cut the various panels at locations of equal thickness.

Cutting the wedge panels to produce shower pans with point and linear drains is simple and readily completed on the jobsite near the shower pan area making the installer more efficient versus mortar-bed and other types of field fabricated shower pans. Because the wedge panels are oversized and can be cut on site, the system can accommodate all shower pan sizes negating the need to order prefabricated tileable shower pans which reduces the overall time and cost to install a tileable shower system. Thus, embodiments of the invention addresses many of the labor issues facing contractors and tile installers today.

Table 1 below gives preferred properties for polyisocyanurate foam panels, in accordance with embodiments of the invention. However, it well be understood that these properties are given as examples only, and that panels having other properties may be used.

| Shear Strength (Under conditions required in ANSI A118.10) | |
|---|---|
| 7 day shear strength: | >50 psi |
| 7 day water immersion shear strength: | >50 psi |
| 28 day shear strength: | >50 psi |
| 100 day water immersion shear strength: | >50 psi |
| Waterproofness; ASTM D4068/ANSI A118.10 | Pass |
| R-Value 75° F. (25°) - ASTM C518 (R Value for 1") | >4 |
| Temperature Limits | −20/+250° F. |
| Freeze & Thaw (ASTM C666 -> 25 Cycles) | No disintegration/ change |
| Fungus/Bacteria Resistance (ASTM G21 G22) | Pass, No Growth |
| Robinson Floor Test (ASTM C627) | 3 cycles or greater |
| Seam Strength (ASTM D751) | >8 lbs per in. |
| Breaking Strength (ASTM D751) | >170 psi |
| Compression Indentation (at 0.05" deformation) | >100 psi |
| Tensile Strength (ASTM C297) | >20 psi |
| Flexural Strength (ASTM C947) | >100 psi |
| Fastener Pull Through (ASTM C473) | >30 lbs |
| Waterproofness of Assembly (ASTM E331) | Passed, assembly (complete system) |
| Linear Variation (ASTM D 1037 (ICC -EG 159)) | less than 0.07% |

The invention has now been described in detail for the purposes of clarity and understanding. However, those skilled in the art will appreciate that certain changes and modifications may be practiced within the scope of the appended claims. It is to be understood that any workable combination of the features and capabilities disclosed above in the various embodiments is also considered to be disclosed.

What is claimed is:

1. A wedge panel having first and second major surfaces joined by perimeter edges, the wedge panel comprising a closed cell foam core;

wherein:

the first and second major surfaces are square or rectangular having a length of at least 2 feet and a width of at least 2 feet;

the perimeter edges comprise a first edge, a second edge opposite the first edge, a third edge extending between the first edge and the second edge, and a fourth edge opposite the third edge and extending between the first edge and the second edge;

a thickness of each of the first edge and the second edge is constant across a length of the respective edge;

a thickness of each of the third edge and the fourth edge tapers from the first edge to the second edge;

the first edge of the wedge panel has a thickness of ¼ inch or less; and the second edge of the wedge panel has a thickness larger than the thickness of the first edge.

2. The wedge panel of claim 1, wherein at least one of the first and second major surfaces comprises an attached facer.

3. The wedge panel of claim 1, wherein when one of the first and second major surfaces is held horizontal, the other of the first and second major surfaces has a slope of between 1 and 5 percent.

4. The wedge panel of claim 1, wherein when one of the first and second major surfaces is held horizontal, the other of the first and second major surfaces has a slope of about 2 percent or more.

5. The wedge panel of claim 1, wherein the distance between the first edge and the second edge is about 4 feet, the thickness of the first edge is about ⅛ inch, and the thickness of the second edge is greater than 1 inch.

6. The wedge panel of claim 1, wherein at least one of the first and second major surfaces comprises at least one worked surface selected from the group consisting of a sawn surface, a milled surface, an abraded surface, a fly cut surface, and a sanded surface.

7. A shower pan for a shower having a drain, the shower pan comprising:

a number of sloped segments joined to from a continuous surface that at all locations slopes downward toward the drain, wherein each sloped segment further comprises a sloped panel having upper and lower major surfaces at an angle to each other, each sloped panel comprising a closed cell foam core;

wherein each of the sloped panels comprises angled edges cut at 45 degrees from a strike line of the upper major surface of the panel, and the angled edges of adjacent sloped panels match;

wherein the shower pan has a rectangular shape;

wherein each of the sloped panels comprises an inner edge proximate the drain and an outer edge opposite the inner edge; and wherein the at least one of the sloped segments comprises a first tapered edge that extends from the outer edge to a first angled edge of the angled edges and a second tapered edge that extends from the outer edge to a second angled edge of the angled edges.

8. The shower pan of claim 7, wherein for each sloped panel, at least one of the upper and lower major surfaces has an attached facer.

9. The shower pan of claim 7, wherein joints between the sloped panels are sealed to form a waterproof shower pan.

10. The shower pan of claim 9, further comprising a finish layer on top of the sloped panels.

11. The shower pan of claim 7, wherein the shower pan is square or rectangular.

12. The shower pan of claim 7, wherein the drain is centered in the shower pan.

13. The shower pan of claim 7, wherein the drain is square, round, or linear.

14. The shower pan of claim 7, wherein the shower pan is curbless.

15. The shower pan of claim 14, further comprising a backer board positioned adjacent the outer edge of one of the sloped segments, wherein the backer board is formed from a same material as each of the sloped segments and has a thickness that matches a thickness of the outer edge of the one of the sloped segments.

16. The shower pan of claim 7, further comprising a curb also comprising a closed cell foam core.

* * * * *